United States Patent [19]

Shukla et al.

[11] Patent Number: 4,576,612

[45] Date of Patent: Mar. 18, 1986

[54] FIXED OPHTHALMIC LENS POLISHING PAD

[75] Inventors: Jayendra G. Shukla, Marietta, Ga.; Ki G. Sohn, Penn Yan, N.Y.; Carl Twickler, Milford; Otto S. de Pierne, E. Norwalk, both of Conn.

[73] Assignee: Ferro Corporation, Cleveland, Ohio

[21] Appl. No.: 616,175

[22] Filed: Jun. 1, 1984

[51] Int. Cl.[4] ..... B24D 11/00

[52] U.S. Cl. ..... 51/295; 51/394; 51/401; 51/407; 51/DIG. 34

[58] Field of Search ..... 51/295, 298, 394, 395, 51/397, 398, 401, 402, 405, 407, DIG. 34; 525/403

[56] References Cited

U.S. PATENT DOCUMENTS

| | | | |
|---|---|---|---|
| 1,507,836 | 9/1924 | King | 51/394 X |
| 3,042,509 | 7/1962 | Soderberg | 51/305 |
| 3,125,544 | 3/1964 | Winslow et al. | 525/403 |
| 3,306,718 | 2/1967 | Chapin | 51/298 X |
| 3,355,272 | 11/1967 | D'Alessandro | 51/298 |
| 4,138,228 | 2/1979 | Hartfelt et al. | 51/295 |
| 4,240,807 | 12/1980 | Kronzer | 51/295 |
| 4,255,164 | 3/1981 | Butzke et al. | 51/407 X |
| 4,307,544 | 12/1981 | Balz | 51/295 X |

*Primary Examiner*—Robert P. Olszewski

*Attorney, Agent, or Firm*—Shlesinger, Fitzsimmons & Shlesinger

[57] ABSTRACT

A rosette shaped polishing pad includes a tough, flexible substrate, which is coated on one side with a layer of pressure sensitive adhesive for securing the pad to a polishing lap or the like, and on its opposite side with a flexible, water soluble matrix containing polishing particles such as cerium oxide, zirconium oxide, iron oxide, or the like, having a particle size in the range of approximately 0.5 to 15 microns. The polishing layer is produced by mixing a water soluble polyalkylene oxide/-phenolic complex with an acrylic latex, and an alcohol slurry containing polishing particles in the form of, for example, cerium oxide particles. In use, water at any desired flow rate is applied to the interface between the lens which is being polished and the layer of polishing material on the pad. During the polishing operation the polyalkylene oxide/phenolic/acrylic binder or matrix slowly dissolves to release the polishing particles in a controlled manner thus providing a glass removal rate necessary to achieve an optical quality polished surface.

10 Claims, 6 Drawing Figures

FIXED OPHTHALMIC LENS POLISHING PAD

BACKGROUND OF THE INVENTION

This invention relates to flexible polishing pads for lenses or the like, and more particularly to an improved pad which utilizes a water soluble binder or matrix for effecting controlled release of polishing particles from the pad during a polishing operation.

As noted in column 1 of U.S. Pat. No. 4,255,164, the principal steps in producing polished optical surfaces, such as for example polished surfaces on glass lenses, comprises three successive operations—namely, a rough generating step using a tool containing a coarse, hard abrasive such as diamond particles, or the like; a grinding or fining step using finer abrasive particles to remove deep scratches and to compensate for slight generating errors and to produce the desired curve on the lens itself; and a final polishing step using a compound of extremely fine particle size for removing small scratches and to provide a smooth lens surface of optical quality. This invention, it will be understood, relates to the above-noted final polishing step, and a novel pad particularly suited for use in such polishing step.

The conventional method of polishing lenses has been to employ a liquid slurry comprising, for example, very fine polishing particles in an aqueous solution. The slurry is applied to the interface between the surface of the lens and the associated polishing pad or lap. Because of the obvious inconvenience of having to employ a slurry which contains polishing particles, efforts have been made over the years to provide a satisfactory polishing pad which can be secured over a polishing lap, and which contains the necessary polishing particles. In this way only water need be applied to the pad during polishing.

U.S. Pat. No. 4,255,164, for example, discloses a flexible, glass fining sheet or pad in which abrasive particles or granules are secured in a water insoluble resinous binder, such as for example a thermosetting polymer modified by a small amount of thermoplastic polymeric latex. During the grinding (fining) operation it is then only necessary to apply water to the interface between the fining pad and the lens surface in order to create the necessary fining slurry. However, as pointed out in column 1 of this patent, a fining sheet or pad of this type is concerned only with the grinding (fining) of the lens surface. The abrasive granules employed for such purpose, therefore, are said to have a Knoop hardness of at least about 1,000 and an average particle size of about 10 to 80 microns, ranges which are not satisfactory for polishing purposes. Moreover, these abrasive particles are released from the water-insoluble binder during grinding as the result of the gradual mechanical erosion of the binder due to the effects of loading and surface friction.

For both fining and polishing operations, experience has indicated that best results are achieved when the abrasive or polishing particles are free to roll or move in the slurry generated between the lens surface and the fining or polishing pad surface. In the case of the above-noted U.S. Pat. No. 4,255,164, this release of the abrasive particles depends solely upon the mechanically induced failure of the binder matrix, rather than upon the binder solubility. In accordance with the teachings of the present invention, however, it has been found that it is not only possible, but is more desirable to produce a polishing pad containing a water-soluble binder which, during use, dissolves at a rate that permits the controlled release of the polishing particles at a predetermined rate, thus considerably increasing the quality, convenience and efficiency of the polishing operation.

Although attempts heretofore have been made to produce a polishing or grinding matrix comprising a water-soluble binder composition, the efforts have proved to be unsatisfactory because of the uncontrolled, rapid disintegration of the matrix. U.S. Pat. No. 3,042,509, for example, proposed using a water soluble matrix for abrasive particles comprising a mixture of polyethlene glycol (20–80%). Such a matrix is solid at room temperature, and has good lubricating properties during use. The problem with this type of matrix is, however, that it dissolves far too rapidly during use, and if used for polishing purposes is incapable of approaching a stock removal rate common to conventional slurry polishing techniques. By way of example, laboratory tests conducted on a conventional Coburn 505 polisher indicate that it is commonplace to achieve stock removal rates of approximately 120 mg. of glass per twelve minutes of polishing a glass lens of 55.5 mm. diameter using a conventional "Pellon" pad under 30 psig., and a slurry comprising a 5% concentration of a cerium oxide polishing compound of the type distributed by Transelco Division of Ferro Corporation under the name "Ce-Rite" Rx 419.

More recently, U.S. Pat. No. 4,138,228 has suggested incorporating a polishing abrasive having an average particle size of less than 10 microns in a microporous polymeric structure, which exists in the form of tiny platelets, rather than in the form of a monolithic film. The alleged advantage of this invention is that the abrasive particles are adhered on the surfaces of the platelets, or at the most are only slightly embedded in the platelets, so that when the abrasive surface of the pad is rubbed against the surface of a glass lens in the presence of water or the like, the combined action of the rubbing and the absorption of the liquid into the microporous or sponge-like polymer matrix effects controlled release of the polishing abrasive from the surface of the platelets. The essence of this type of pad is the fact that the particles are substantially entirely unencapsulated by the binder, so that during the polishing process they are released as the result of the mechanical activity generated during polishing.

It is an object of this invention, therefore, to provide an improved polishing pad which utilizes a water soluble matrix that is specifically designed to provide controlled, gradual release of polishing particles during a polishing operation.

Other objects of the invention wll be apparent hereinafter from the specification and from the recital of the appended claims, particularly when read in conjunction with the accompanying drawings.

SUMMARY OF THE INVENTION

In its preferred form, the polishing layer for the polishing pad is prepared by mixing a water soluble polyalkylene oxide/phenolic complex with an acrylic latex and a cerium oxide alcohol slurry. More specifically, the polyalkylene oxide has an alkyl carbon chain of 5 or less, including, for example, polyethylene oxide. In one example polyethylene oxide is combined with a phenolic to form a complex which is then mixed with an acrylic latex and a cerium oxide alcohol slurry in weight ratios which may be, by way of example, approximately 16%, 8%, and 76%, respectively. The rate at which the cerium oxide polishing particles are released from the polyalkylene oxide/phenolic/acrylic binder or matrix is a function of the rate at which the water soluble binder dissolves when water is applied to the pad during a polishing operation. This dissolution rate is also a function of the weight ratio of the polyalkylene oxide to the phenolic component, and for purposes of this invention this ratio is preferably in the range of 30–70% polyalkylene oxide to 70–30% phenolic.

Although not as satisfactory as the matrix produced from the polyalkylene oxide/phenolic complex, water soluble binders can also be produced from water soluble polymers such as intermediately hydrolyzed polyvinyl alcohols mixed with an acrylic latex and a cerium oxide slurry in water, for example in the weight ratios of 15% to 8% to 77%.

THE DRAWINGS

Figure 1:
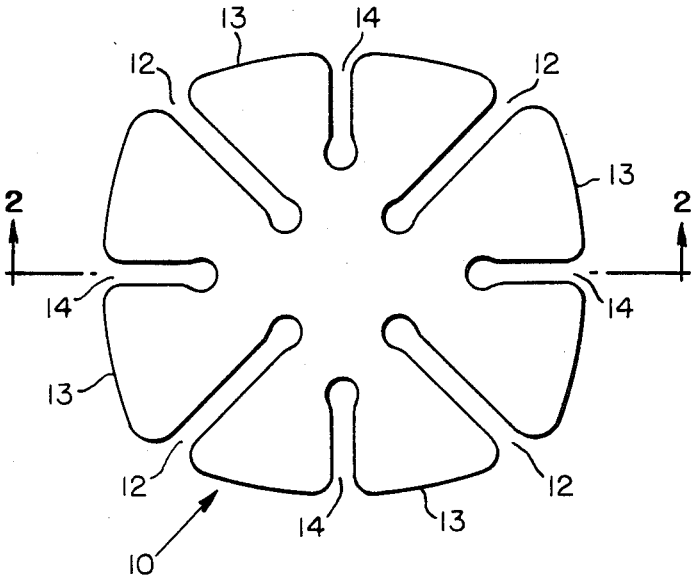
FIG. 1 is a plan view of a typical polishing pad made according to one embodiment of this invention.

Referring now to the drawings by numerals of reference, 10 denotes generally a rosette shaped polishing pad having therein a first set of four, equi-angularly spaced radial slots 12, which divide the pad into four, similarly shaped leaf or petal shaped sections 13. Each of the leaf sections 13 is in turn subdivided into two separate sections by a second set of four, radially extending slots 14, which are formed in the pad in equi-angularly spaced relation to one another and to the slots 12. Slots 14, it will be noted, do not extend radially inwardly as far as the slots 12; and each of the slots 12 and 14 is rounded at its inner end. The rosette or flower-like configuration of pad 10 serves the dual purpose of permitting the pad better to conform to polishing or lapping tools, when the pad is used for polishing curved lenses, and at the same time permits rapid penetration and dispersement of the water supply which is used during the polishing operation.

Pad 10 comprises a polishing layer or face 21, which has been deposited on the upper surface of a flexible, fabric substrate 23 and 23' which is designed to provide a cushioning and reinforcing support for the polishing layer. The upper surface of the reinforcing substrate may be substantially planar, as with layer 23 (FIG. 2) in which case it would be completely covered by the polishing layer 21; or alternatively, the upper surface could contain spaced recesses or corrugations as in the case of layer 23' (FIG. 2A). In the embodiment shown in FIG. 2A the polishing layer could be applied either completely to cover the surface of layer 23' or partially to fill its recesses as at 21' in FIG. 2A, so that portions of layer 23' will project above the polishing layer 21'. In either embodiment portions of layer 21 or 21' may actually penetrate into the reinforcing substrate.

Secured to the back or underside of substrate 23 by a layer 25 of adhesive is a thin film or layer 26 of plastic, such as polyester or the like. Coated on the back or lower side of this plastic film is a layer or coating 27 of a pressure sensitive adhesive material, the underside or lower face of which is covered in a conventional manner with a removable layer 28 of release paper, which shields the pressure sensitive adhesive until the pad 10 is placed in use.

The fabric substrate 23 may be made, for example, from a spun bonded polyester such as is sold by E. I. du Pont de Nemours & Co. under the trademark "Reemay". Alternatively, of course, non-woven nylon or woven polyester, polyester/cotton blends, cotton and similar fabrics could be employed for this purpose. The reinforcing film 26 cooperates with the substrate 23 to enable the pad 10 to be removed or peeled from a polishing lap when the pad requires replacement. In this connection the adhesive layer 27, which is used to adhere the pad 10 to a lap, should have good wet shear strength to prevent pad movement during polishing and moderate peel strength so that it can be peeled from the lap without leaving objectionable traces of the adhesive on the lap surface.

Figure 2:
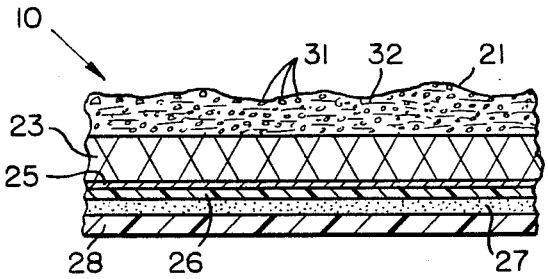
FIG. 2 is a greatly enlarged, fragmentary diagramatic view of this pad as it would appear in section taken along the line 2—2 in FIG. 1.
Figure 2A:
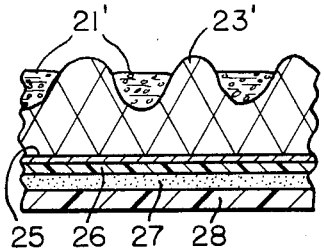
FIG. 2A is a fragmentary sectional view similar to FIG. 2 but showing a modified form of this pad.

The polishing layer 21 comprises two basic components: a plurality of fine polishing particles which are denoted by way of example at 31 in FIG. 2, and a resinous matrix or binder 32 in which the particles 31 are dispersed. The polishing particles 31 may comprise cerium oxide particles, or any suitable known polishing compound having an average particle size in the range of from less than 0.5 microns to approximately 15 microns, and with a typical range of from 1.0 to 8.0 microns.

It has been found that a particularly suitable water soluble binder or matrix 32 can be produced by combining an acrylic latex or the like, with a complex of polyalkylene oxide and phenol formaldehyde, wherein the polyalkylene oxide has a molecular weight in the range of 100,000 to 600,000. Various ways of associating or complexing a phenolic component with a polymeric oxygen ether component are disclosed in U.S. Pat. No. 3,125,544. In the case of the present invention, the complexing of these components might be visualized as a loose network formulation by hydrogen bonding between phenolic hydroxyl groups in the phenol-formaldehyde resin and oxygen in the polyalkylene oxide polymer:

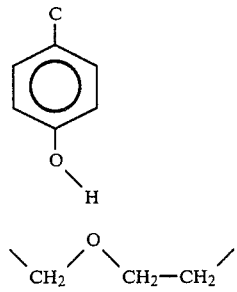

As will be apparent hereinafter, the solubility of this particular complex is, for the most part, dependent upon the ratio to the phenolic to the polyalkylene oxide. The higher the phenolic content the more insoluble is the binder; while on the other hand the higher the content of the polyalkylene oxide, the more soluble is the binder. The best ratios to obtain the desired solubility of the binder depend, among other factors, upon the reactivity of the phenolic component. Another important factor which affects the solubility of this complex is the inclusion of alcohol, which as noted hereinafter, is employed during preparation of the polyalkylene oxide/-phenolic complex and, preferably, in the slurry. Water miscible alcohols appear to have some solvating effect on the hydroxyl groups in the phenol formaldehyde, and conceivably delay the rapid complexing of the system by stabilizing the phenolformaldehyde.

To determine the most desirable composition of the water soluble binder 32 (FIGS. 2 and 2A) a series of tests were conducted on polishing pads for which the matrix material was made in accordance with the following examples, wherein the percentages refer to dry weight percentages, except for water and alcohol:

EXAMPLE NO. 1

Polyox(polyethylene oxide), for example as sold by Union Carbide under the designation "WSRN-80", alcohol (Isopropanol) and water were mixed in ratios of 20%, 40% and 40%, repsectively. (Preferably the alcohol and water are mixed first, and the Polyox is then added.) This Polyox solution was then combined with phenol formaldehyde (e.g. Union Carbide "BRL-1302") in a one to one ratio (50% of the Polyox, dry wt., and 50% phenol formaldehyde.) A cerium oxide slurry was then prepared by mixing a commercially available polishing compound containing fine cerium oxide particles (e.g. "Ce-Rite" 403) with a water miscible alcohol, again such as Isopropanol. An acrylic latex and the Polyox/phenolic complex were then added to the cerium oxide slurry in the ratios of 8% latex, 16% Polyox-/phenolic complex, and 76% cerium oxide slurry.

EXAMPLE NO. 2

The same procedures were followed as in Example 1, except that the ratio of polyethylene oxide to phenol formaldehyde during preparation of the Polyox-/phenolic complex was 40% Polyox to 60% phenolic resin.

EXAMPLE NO. 3

The same as Example 1, except that the Polyox to phenolic ratio was 60% to 40%.

EXAMPLE NO. 4

The same as Example 1, except that the Polyox to phenolic ratio was 30% to 70%.

EXAMPLE NO. 5

Instead of using a Polyox/phenolc complex, this binder was produced by mixing a water soluble polymer in the form of an intermediately hydrolyzed polyvinyl alcohol (15%) with an acrylic latex (8%) and a thickener (e.g. Acrysol ASE-60) (0.5%), and a cerium oxide slurry in water (76.5%). The water soluble polymer was a 95% hydrolyzed PVOH such as sold for example by Air Products, Inc. under the mark "Vinol-425". The acrylic latex was a mix of 4% "Ucar 154" and 4% "Ucar 189".

EXAMPLE NO. 6

A cerium oxide slurry was prepared by mixing cerium oxide particles (75 wt. %) with a solution (25 wt. %) of equal parts of water and Isopropanol. Polyox (WSRN-750) was mixed with water in ratios of 10% Polyox to 90% water. The cerium oxide slurry and polyox-water solution were mixed together in the dry weight ratios of 90% cerium oxide and 2.4% Polyox, and then combined with 5.2 dry wt. % of phenol formaldehyde (Union Carbide BRL1100). An acrylic latex (e.g. Union Carbide's Ucar 189) was then added in an amount of 2.4 wt. % to complete the polishing layer formulation.

EXAMPLE NO. 7

The same procedures were followed as in Example 6, except that the Polyox material was of the WSRN-80 variety and was mixed with water in the ratio of 20% Polyox to 80% water. This solution was mixed with a cerium oxide slurry of the type noted in Example 6, but in dry weight ratios of 93% cerium oxide and 2.6% Polyox. Phenol formaldehyde (Union Carbide BKUA 2370) was then added in the amount of 2.9 wt. % followed by 1.5 wt. % of Ucar 189 acrylic latex.

EXAMPLE NO. 8

Polyethylene oxide (Union Carbide WSRN-80) was mixed with a quantity of a non-ionic surfactant ("Tergitol NP-13") in an amount sufficient to prevent flocculation of the Polyox when subsequently mixed with a cerium oxide polishing compound. This Polyox/surfactant composition was mixed in an amount of approximately 15% with an acrylic latex (8%) and a cerium oxide polishing compound in water (77%).

In use, a pad 10 having thereon a polishing layer matrix 32 made in accordance with Examples 1, 6 and 7 (above) were found to be most effective in exhibiting controlled release of the polishing particles during polishing. Tests have indicated that these results are attributable to the gradual dissolving of the thermoplastic matrix or binder system during polishing of glass lenses using only water. A matrix or binder made from this material results in a polishing layer which is thermoplastic and embosses rather easily. This is a desirable property in connection with a polishing pad of the type described in FIG. 2, since the embossing allows water to seep in an around the embossed portions of the pattern, thus enhancing polishing and also preventing undesirable suction between the pad and the lens which is being polished.

Figure 3:
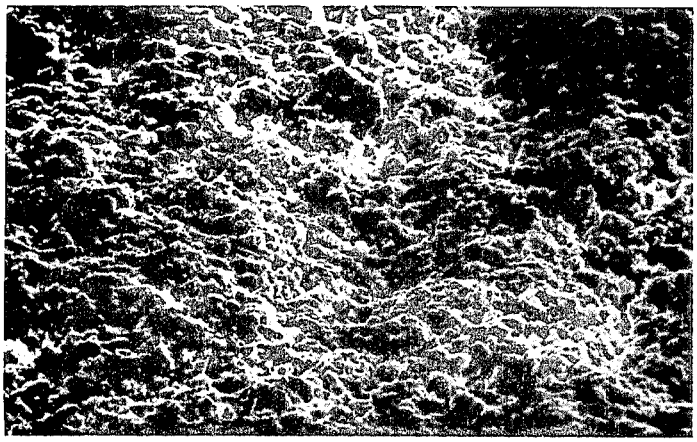
FIG. 3 is a photomicrograph showing enlarged by 1000x a plan view of a portion of the polishing surface of an unused pad of the type shown in FIG. 1.
Figure 4:
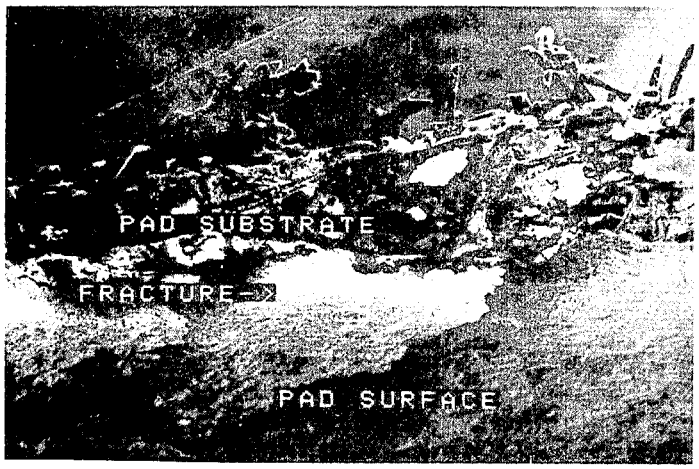
FIG. 4 is a photomicrograph showing enlarged by 50x an upside down cross sectional view of a fractured portion of the pad shown in FIG. 3.
Figure 5:
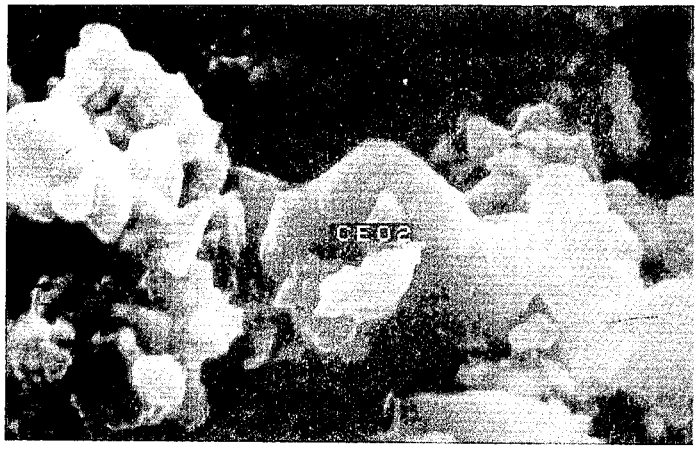
FIG. 5 is a photomicrograph of the same cross sectional view shown in FIG. 4, but enlarged by 10,000x.

As shown perhaps more clearly in FIGS. 3–5, wherein the cross sectional views of FIGS. 4 and 5 were prepared by lowering the pad temperature below its brittle transition temperature with liquid nitrogen and then fracturing the pad, it will be apparent that the binder material in the polishing layer 21 forms a relatively homogeneous, monolithic film in which the cerium oxide particles are bonded with the polyalkylene oxide polymer. Tests have indicated that it is the polyalkylene oxide binder which goes into solution during polishing with a water slurry, and in so doing slowly releases the cerium oxide particles for rolling movement between the polishing pad and the surface that is being polished.

As used in connection with the novel polishing pads disclosed herein, the water slurry refers to the water which is applied to the interface between a polishing pad and, for example, a lens during the polishing of the latter. The alcohol and water slurries referred to in Example 1 to 7 exist in slurry form only for the purpose of enabling the cerium oxide particles and the complex polymer matrix material to be coated in a thin layer on the substrate 23 or 23', after which the liquids in these slurries evaporate, leaving the flexible polishing layer 21 or 21' on the associated substrate.

As noted above, Examples 1, 6 and 7 provide the most desirable binders and the best glass removal rates during polishing, ranging from 120 to 144 mg. per twelve minutes. The binders of Examples 2 and 3 also provide a gradual release of the polish particles during use of the pad with water, but result in a somewhat less desirable binder than that produced by Examples 1, 6 and 7. Example No. 4 was not satisfactory because the pad matrix was nearly insoluble in water during use, and was extremely difficult to emboss.

The material of Example No. 5 also produced a reasonably satisfactory binder which was gradually soluble in water during use, but its glass removing ability during polishing was slightly less than that resulting from the binders made according to Examples 1 to 3, 6 and 7. Example 8, which utilized a mixture of latex, Polyox and a cerium oxide slurry in water, was capable of good glass removal during polishing, but proved to be too soluble in water during use. Also its tendency to flocculate produced inconsistent test results.

In addition to the above-described examples, an all latex binder system was tested but proved to be very insoluble in water and did not satisfactorily release the polishing particles during use. Tests were also conducted using water soluble polymers as the sole binder (exclusive of latex), but these binder systems proved to be too soluble and released the polishing particles too rapidly with consequent poor polishing results.

In all the tests which were conducted, the effectiveness of a given pad was not dependent upon the rate at which water was supplied to the interface between the pad and the lens being polished. This contrasts with some types of pads which require careful control of the rate of application of the water to the polishing interface.

From the foregoing, it will be apparent that although it is possible to produce for polishing pads of the type disclosed herein a polishing layer binder made from a water soluble polyalkylene oxide polymer and a compatible latex, nevertheless the best results are achieved by modifying the polymer with a phenolic component, which tends to reduce the solubility of the polymer during polishing operations of the type described herein. Such a polyalkylene oxide/phenolic/latex binder system also functions most efficiently when prepared in the presence of alcohol and water. When the binder is based upon a combination of a water soluble polymer and latex (Example No. 5), excluding the phenolic component, then it is possible to use only water in preparing the polishing layer.

It will be apparent to one skilled in the art, that instead of cerium oxide particles, the slurry may contain other polishing particles, such as for example iron oxide or zirconium oxide, particularly in connection with the polishing of glass lenses. For polishing other types of vitreous surfaces, or for plastic lenses, still other known types of polishing particles can be employed. Moreover, it will be obvious also that the various components of the matrix 32 do not have to be mixed in the precise order disclosed by the above-noted examples. For example, when isopropanol is used, it matters not if it is mixed with either the cerium particles, the polyethylene oxide, or both. Furthermore, while this invention has been illustrated and described in detail in connection with only certain embodiments thereof, it will be apparent that it is capable of still further modification, and that this application is intended to cover any such modifications as may fall within the scope of one skilled in the art or the appended claims.

What we claim is:

1. A pad for polishing optical quality surfaces, including a flexible support, and a flexible layer of polishing material secured to one surface of said support, said layer of polishing material comprising, a flexible matrix secured to said one surface of said support and containing a plurality of polishing particles ranging in size of from less than 0.5 microns to approximately 15 microns, said matrix comprising in combination a latex material and a water soluble polymer, said polymer being present in a quantity approximately equal to or greater than that of said latex material, said matrix being water soluble, allowing a gradual release of said polishing particles as the matrix is dissolved by water used in a polishing operation.

2. A pad as defined in claim 1, wherein said polymer is selected from the group consisting of a polymeric oxygen ether compound and a hydrolyzed polyvinyl alcohol.

3. A pad as defined in claim 2, wherein said polymer is an intermediately hydrolyzed (95%) polyvinyl alcohol and said latex material is an acrylic latex.

4. A pad as defined in claim 3, wherein said polyvinyl alcohol is initially present in said matrix in a weight percentage approximately twice that of said acrylic latex.

5. A pad as defined in claim 2, wherein said polymeric oxygen ether compound is polyalkylene oxide, and is complexed with phenolic resin.

6. A pad as defined in claim 5, wherein the ratio by dry weight of said polyalkylene oxide to said phenolic resin is in the range of 30–70% polyalkylene oxide to 70–30% phenolic resin.

7. A pad as defined in claim 5, wherein said polyalkylene oxide has an alkyl carbon chain of 5 or less.

8. A pad as defined in claim 2, wherein said polymeric oxygen ether compound is polyalkylene oxide mixed with a nonionic surfactant, and is present in a weight percentage approximately twice that of the latex.

9. A pad as defined in claim 1, wherein said support comprises a substrate having said layer of polishing material secured to one side thereof, a thin, tough film of plastic secured to the opposite side of said substrate, and adhesive means on the side of said film opposite said substrate for removably attaching said pad to a tool.

10. A pad as defined in claim 9, wherein said one side of said substrate has therein a plurality of spaced recesses at least partially filled with said polishing material.

* * * * *